United States Patent [19]

Minamizono et al.

[11] 4,426,445

[45] Jan. 17, 1984

[54] SILVER HALIDE PHOTOGRAPHIC LIGHT-SENSITIVE MATERIAL

[75] Inventors: Junji Minamizono; Mitunori Hirano; Yoshiro Kawashima; Tadashi Ogawa, all of Minami-ashigara, Japan

[73] Assignee: Fuji Photo Film, Co., Ltd., Minami-ashigara, Japan

[21] Appl. No.: 479,119

[22] Filed: Mar. 31, 1983

Related U.S. Application Data

[63] Continuation of Ser. No. 261,327, May 7, 1981, abandoned.

[30] Foreign Application Priority Data

May 7, 1980 [JP] Japan ..... 55-60359

[51] Int. Cl.[3] ..... G03C 1/28

[52] U.S. Cl. ..... 430/599; 430/600; 430/603

[58] Field of Search ..... 430/599, 600, 603, 607, 430/613, 614

[56] References Cited

U.S. PATENT DOCUMENTS 3,617,280 11/1971 Huckstadt et al. ..... 430/600
3,706,562 12/1972 Herz et al. ..... 430/600
3,843,368 10/1974 Yamamoto et al. ..... 430/528

*Primary Examiner*—Won H. Louie, Jr.
*Attorney, Agent, or Firm*—Sughrue, Mion, Zinn, Macpeak & Seas

[57] ABSTRACT

A silver halide photographic light-sensitive material comprising a support having coated thereon at least one silver halide emulsion layer. The material contains at least one compound selected from the group consisting of a compound represented by the following general formula (I) and a compound represented by the following general formula (II) in at least one layer of the silver halide emulsion layer and other hydrophilic colloid layers thereof;

General Formula (I)

General Formula (II)

wherein R represents an alkyl group having 1 to 6 carbon atoms which may be substituted, an aryl group having 6 to 11 carbon atoms which may be substituted, or an aralkyl group having 7 to 12 carbon atoms which may be substituted; A represents a $\sigma$ bond or a divalent connecting group which links R and the nitrogen atom; $R_1$ and $R_2$ are independently hydrogen, an alkyl group having 1 to 6 carbon atoms which may be substituted, or an aralkyl group having 7 to 11 carbon atoms which may be substituted, or when A represents a $\sigma$ bond, $R_1$ and $R_2$ each may represent an atomic group necessary to form a heterocyclic ring containing the quaternary nitrogen atom together with R; a and b each represents 0 or a positive integer, provided that a and b are not both 0; $R_3$, $R_4$, $R_5$ and $R_6$ each represents hydrogen or an alkyl group having 1 to 6 carbon atoms which may be substituted and when b is not 0, at least one of $R_5$ and $R_6$ is a different group from $R_3$ or $R_4$; B represents —COO or —$SO_3$; and Z represents an atomic group necessary to form a heterocyclic ring.

The photographic light-sensitive material has a high sensitivity without being accompanied by an undesirable increase in the formation of fog.

25 Claims, No Drawings

SILVER HALIDE PHOTOGRAPHIC LIGHT-SENSITIVE MATERIAL

This application is a continuation of application Ser. No. 261,327, filed May 7, 1981, now abandoned.

FIELD OF THE INVENTION

The present invention relates to a photographic light-sensitive material and more particularly to a chemically sensitized silver halide photographic light-sensitive material.

BACKGROUND OF THE INVENTION

Various means of chemical sensitization for increasing the light sensitivity of silver halide photographic emulsions are known. One typical method is sulfur sensitization, wherein the light sensitivity of a silver halide photographic emulsion is increased by adding thereto a very small amount of sulfur or a sulfur compound to form silver sulfide. Examples of such methods are shown in U.S. Pat. Nos. 2,410,689 and 3,501,313, West German Pat. No. 1,422,869, and Japanese Patent Publication No. 20533/74.

Other methods for increasing the light sensitivity of silver halide photographic emulsions are carried out by adding thereto a suitable reducing agent or gold compound. These methods are known as reduction sensitization and gold sensitization, respectively, and are disclosed in U.S. Pat. Nos. 2,399,083 and 3,297,446.

Furthermore, it is known to increase the light sensitivity of silver halide emulsions by a combination of these sensitization methods, as described in T. H. James, *The Theory of the Photographic Process,* 4th Edition, pp. 149–160 (Macmillan Pub. Co., 1977).

In these conventional sensitization methods, as the amount of sensitizer is increased to obtain higher light sensitivity, the silver halide photographic emulsions tend to form fog. It is difficult to control the formation of fog even by using antifoggants or stabilizers. Furthermore, the photographic characteristics of films prepared with silver halide photographic emulsions sensitized by such conventional sensitization methods change greatly when they are stored under high temperature and high humidity conditions.

Attempts to improve the light sensitivity of silver halide emulsions by prolonging the chemical ripening period of increasing the ripening temperature have not been successful, and are accompanied by an increase in the formation of fog.

SUMMARY OF THE INVENTION

It is, accordingly, a first object of the present invention to provide a photographic light-sensitive material, the sensitivity of which has been improved without increasing fog which is harmful to photographic characteristics.

A second object of the present invention is to provide a photographic light-sensitive material which is less subject to a reduction in sensitivity when stored under high temperature and high humidity conditions.

A third object of the present invention is to provide a method for increasing the sensitivity of a photographic light-sensitive material without increasing fog which is harmful to photographic characteristics.

These and other objects of the present invention, that will become more apparent from the following detailed description and Examples. The present invention is achieved by incorporating a specific compound represented by the general formula (I) or (II) described below into at least one layer of the silver halide emulsion layers and other hydrophilic colloid layer thereof:

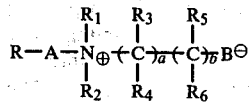

General Formula (I)

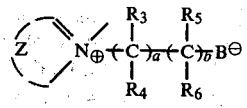

General Formula (II)

wherein R represents an alkyl group having 1 to 6 carbon atoms which may be substituted, an aryl group having 6 to 11 carbon atoms which may be substituted or an aralkyl group having 7 to 12 carbon atoms which may be substituted; A represents a $\sigma$ bond or a divalent connecting group which links R and the nitrogen atom; $R_1$ and $R_2$ are independently an alkyl group having 1 to 6 carbon atoms which may be substituted or an aralkyl group having 7 to 11 carbon atoms which may be substituted, or when A represents a $\sigma$ bond, one of $R_1$ and $R_2$ may represent an atomic group necessary to form a heterocyclic ring containing the quaternary nitrogen atom together with R; a and b each represents 0 or a positive integer, provided that a and b and not both 0; $R_3$, $R_4$, $R_5$ and $R_6$ each represents hydrogen or an alkyl group having 1 to 6 carbon atoms which may be substituted and when b is not 0, at least one of $R_5$ and $R_6$ is a different group from $R_3$ or $R_4$; B represents —COO or —$SO_3$; and Z represents an atomic group necessary to form a heterocyclic ring.

DETAILED DESCRIPTION OF THE INVENTION

The incorporation of a surface active agent having a betaine group (amphoteric group) into a photographic light-sensitive material is described in U.S. Pat. No. 3,843,368. However, the compounds of the present invention are not specifically described in the prior art and are essentially different from the known surface active agents in the following points.

(i) The compounds according to the present invention provide remarkable sensitizing effects. Known compounds do not exhibit such effects.

(ii) Known compounds have properties of surface active agents. For example, Compound (1) described in U.S. Pat. No. 3,843,368, which is represented by the following formula:

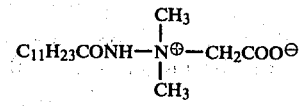

is apparently a surface active agent in that the surface tension of a 1% by weight aqueous solution of said compound (1) at a temperature of 20° C. is no more than 26 dyne/cm (incidentally, the surface tension measured under the same conditions and methods as above except for a concentration of said compound (1) in aqueous solution is 45 dyne/cm in 0.01% by weight and 26 dyne/cm in 0.1% by weight); whereas compounds used in the present invention have no property of surface active agents in that the surface tension of a 1% by weight aqueous solution of the compounds used in the present invention at a temperature of 20° C. is 45 dyne/cm or more.

(iii) Known compounds are employed as antistatic agents or a coating aid. However, the compounds of the present invention are ineffective for such purposes.

The incorporation of a compound having an amphoteric group as a spectral sensitizing dye into a photographic light-sensitive material is known. However, compounds of the present invention are clearly distinguishable from known spectral sensitizing dyes, since compounds of the present invention are substantially colorless, that is, they do not have any optical absorption in a visible range, more generally, in a range having a wavelength more than 400 nm.

The compounds of the present invention which are capable of giving effects different from known compounds are represented by the following general formula (I) or (II).

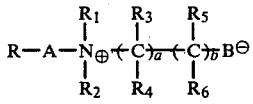

General Formula (I)

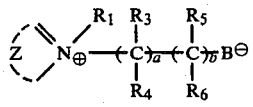

General Formula (II)

In the above formula, R represents (a) to (c) described below. Of these groups (a) is particularly preferred.

(a) An alkyl group having 1 to 6 carbon atoms, preferably 1 to 4 carbon atoms which may be substituted. Preferred examples of the substituents include, for example, a hydroxy group, a halogen atom and a

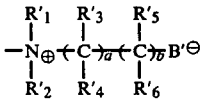

group (wherein $R'_1$, $R'_2$, $R'_3$, $R'_4$, $R'_5$, $R'_6$ and B' each has the same meaning as defined for $R_1$, $R_2$, $R_3$, $R_4$, $R_5$, $R_6$ and B, or $R_1$ and $R'_1$ or $R_2$ and $R'_2$ are bonded each other inclusive of R to form a heterocyclic ring, for example,

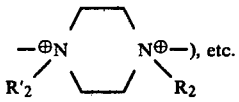

Specific examples of (a) include a methyl group, an ethyl group, a propyl group, a hydroxyethyl group, a

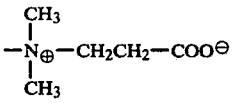

group.

(b) An aryl group having 6 to 11 carbon atoms, preferably 6 to 9 carbon atoms which may be substituted. Preferred examples of the substituents include a lower alkyl group (preferably an alkyl group having 1 to 4 carbon atoms), a hydroxy group, a halogen atom and a nitro group. Specific examples of (b) include a phenyl group, and a p-hydroxyphenyl group.

(c) An aralkyl group having 7 to 12 carbon atoms, preferably 7 to 9 carbon atoms which may be substituted. Preferred examples of the substituents include a lower alkyl group (preferably an alkyl group having 1 to 4 carbon atoms), a hydroxy group, a halogen atom and a nitro group. A specific example of (c) is a benzyl group.

In the above formula, A represents a $\sigma$ bond or a divalent connecting group which links R and the nitrogen atom. The divalent connecting group is not particularly limited, but the following (a) to (d) are preferred.

(a) an —O— group (b) a —COO—$R_7$— group wherein $R_7$ represents a divalent connecting group, preferably an alkylene group having 1 to 6 carbon atoms, and most preferably an alkylene group having 1 to 4 carbon atoms (c) an —O—CO—$R_7$— group wherein $R_7$ has the same meaning as defined above.

(d) a

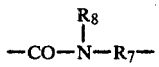

group wherein $R_7$ has the same meaning as defined above, and $R_8$ represents hydrogen, an alkyl group having 1 to 6 carbon atoms preferably 1 to 4 carbon atoms which may be substituted (the preferably substituents including a hydroxy group, a halogen atom) or an atomic group necessary to form a heterocyclic ring (preferably a piperazine ring) together with $R_1$, $R_2$ or $R_7$. Of these groups, hydrogen and an alkyl group having 1 to 4 carbon atoms are preferred for $R_8$.

Of these groups, a $\sigma$ bond, (b) and (d) are preferred, and a $\sigma$ bond and (d) are particularly preferred for A.

In the above general formula, $R_1$ and $R_2$, which may be the same or different, each represents the following (a) to (d)

(a) hydrogen (b) an alkyl group having 1 to 6 carbon atoms preferably 1 to 4 carbon atoms which may be substituted. Preferred examples of the substituents include a hydroxy group and a halogen atom. Specific examples of (b) are preferably a methyl group, an ethyl group or a hydroxyethyl group.

(c) an aralkyl group having 7 to 11 carbon atoms, preferably 7 to 9 carbon atoms which may be substitituted. Preferred examples of the substituents include a hydroxy group, a halogen atom, a nitro group and a lower alkyl group (preferably an alkyl group having 1 to 4 carbon atoms). A specific example of (c) is a benzyl group.

(d) In the general formula (I), when A represents a $\sigma$ bond, $R_1$ and $R_2$ each may represent an atomic group necessary to form a heterocyclic ring containing the quaternary nitrogen atom together with R. The heterocyclic ring is preferably a 5-membered or 6-membered saturated heterocyclic ring including the quaternary nitrogen atom and may further include an oxygen atom or a nitrogen atom (which is not a quaternary nitrogen atom). Specific preferable examples of the heterocyclic ring include a piperidine ring, a piperazine ring, a morpholine ring.

Of the above described groups, (b) and (d) are particularly preferred for $R_1$ or $R_2$.

In the general formulae described above, a and b each represents 0 or a positive integer (preferably from 1 to 6, and particularly from 1 to 4) provided that a and b are not both 0.

In the general formulae described above, $R_3$, $R_4$, $R_5$ and $R_6$ each represents hydrogen, an alkyl group having 1 to 6 carbon atoms, preferably 1 to 4 carbon atoms which may be substituted (preferably substituents include a hydroxy group, and a halogen atom) and when b is not 0, at least one of $R_5$ and $R_6$ is a different group from $R_3$ or $R_4$. Specific preferable exaxmples of $R_3$ to $R_6$ include hydrogen, a methyl group or an ethyl group.

In the above described general formulae, B represents —COO or —$SO_3$.

In the above described general formula, Z represents an atomic group necessary to form a heterocyclic ring. The heterocyclic ring is preferably a 5-membered or 6-membered heterocyclic ring including the quaternary nitrogen atom and may further include an oxygen atom or a nitrogen atom (which is not a quaternary nitrogen atom). Specific preferable examples of the heterocyclic rings include a pyridine ring, an imidazole ring and a benzimidazole ring.

Of the above described compounds represented by the general formulae (I) and (II), the compounds represented by the general formula (I) are more preferred.

Of the compounds represented by the general formula (I) or (II), representative preferred examples are illustrated below, but the present invention is not to be construed as being limited thereto.

(I-1)

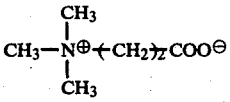

(I-2)

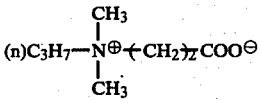

(I-3)

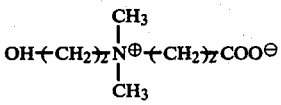

(I-4)

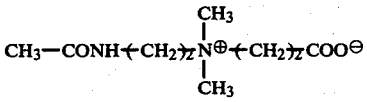

(I-5)

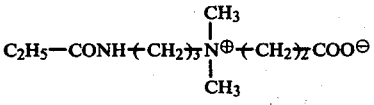

(I-6)

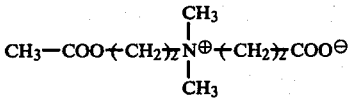

(I-7)

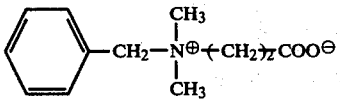

-continued (I-8)

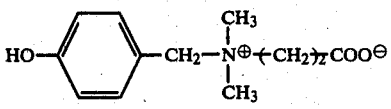

(I-9)

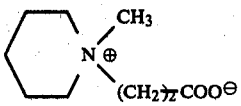

(I-10)

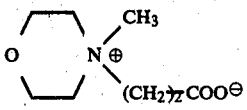

(I-11)

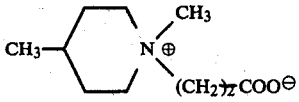

(I-12)

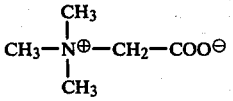

(I-13)

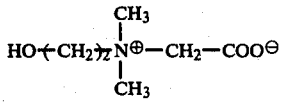

(I-14)

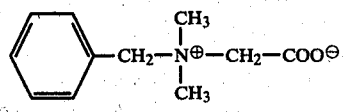

(I-15)

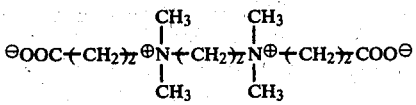

(I-16)

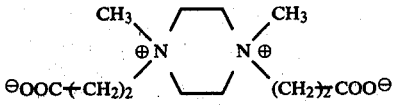

(I-17)

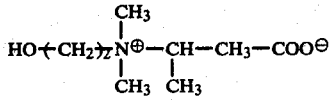

(I-18)

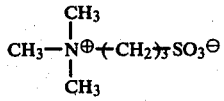

(I-19)

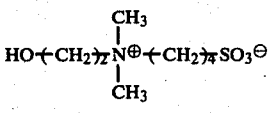

(I-20)

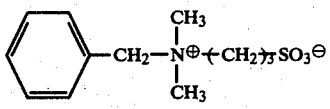

(II-1)

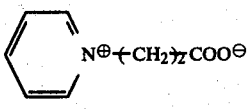

-continued (II-2)

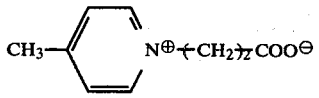

(II-3)

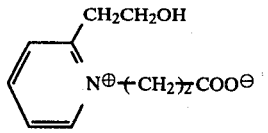

(II-4)

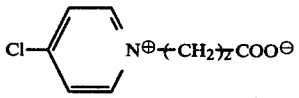

(II-5)

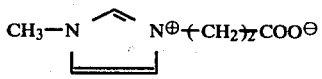

(II-6)

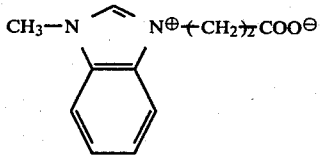

(II-7)

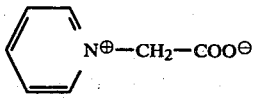

The compounds which can be used in the present invention can be synthesized with reference to the methods described in U.S. Pat. Nos. 2,777,872, 2,846,417, 3,411,912, 3,832,185, 4,012,437, Japanese Patent Publication Nos. 3832/70, 19951/70, 30293/71, 1040/74, Berichte, Vol. 15, p. 1251 (1882), *Polymer*, Vol. 18, p. 1058 (1977), *Yakugaku Zasshi*, Vol. 87, p. 1422 (1967) all of which are incorporated herein by reference.

Synthesis examples of representative compounds which can be used in the present invention are illustrated below.

SYNTHESIS EXAMPLE 1

Synthesis of Compound (I-3)

10.00 g (0.1388 mol) of β-propiolactone and 50 ml of methyl ethyl ketone were put into a reaction vessel and cooled to −20° C. with stirring. A solution mixture of 12.36 g (0.1388 mol) of dimethylaminoethanol and 50 ml of methyl ethyl ketone was added dropwise thereto while controlling the temperature of the system so as not to exceed −10° C. over a period of 25 minutes. The reaction solution was allowed to stand overnight at from 0° C. to 5° C. while white hygroscopic crystals were deposited. The crystals were collected by filtration, washed with acetone and dried to obtain 18 g of the above described compound (yield: 80.5%). The structure of the compound was confirmed by NMR spectrum, elemental analysis, and infrared absorption spectrum.

Synthesis Example 2

Synthesis of Compound (I-14)

94.5 g (1 mol) of monochloroacetic acid and 350 ml of methanol were put into a reaction vessel and stirred while maintaining a temperature of 0° to 5° C. 193 g of a 28% methanol solution of sodium methylate was gradually added dropwise thereto while maintaining the temperature of the system at 30° C. or less. Then a solution containing 135.2 g (1 mol) of dimethyl benzyl amine dissolved in 300 ml of methanol was added thereto. Then the mixture was heated to 60° C. and stirred for 10 hours. The sodium chloride thus formed was removed by filtration, and the filtrate was crystallized in a large amount of acetone. The white crystals were than recrystallized from ethanol to obtain 135 g of the above described Compound (I-14) (yield: 70%). The identification of the compound was carried out in the same manner as described above.

Synthesis Example 3

Synthesis of Compound (I-17)

86 g (1 mol) of β-butyrolactone and 300 ml of acetonitrile were put into a reaction vessel and cooled to −20° C. with stirring. A solution containing 89.1 g (1 mol) of dimethylaminoethanol dissolved in 300 ml of acetonitrile was added dropwise thereto while controlling the temperature so as not to exceed −10° C. The temperature of the system was gradually elevated with stirring and stirred at 10° C. for 5 hours while white crystals were deposited. The crystals were collected by filtration, washed twice with 300 ml of acetonitrile and dried to obtain 132 g of the above described compound. (yield: 80%). The identification of the compound was carried out in the same manner as described above.

Other compounds can be easily synthesized in the same manner as described above.

According to the present invention, at least one of the compounds described above is added to a silver halide emulsion layer, another hydrophilic colloid layer or both layers. Examples of the another hydrophilic colloid layers include an over coat layer, a filter layer and an interlayer. It is preferable for the compounds to be in a layer adjacent to a silver halide emulsion layer.

When the compound is incorporated into a silver halide emulsion layer (which is a most preferred embodiment of the present invention), the compound can be added at any stage of preparation of the emulsion. However, it is preferable to add the compound during chemical ripening, or after chemical ripening but before coating of the emulsion.

The amount of the compound used according to the present invention can be varied, depending upon the kind of silver halide emulsion, the kind of the compound used, etc., but it is preferably used in an amount of from about 0.001 to 1 mol, and more preferably from 0.01 to 0.5 mol, per mol of silver halide.

The value of pAg (logarithm of the reciprocal of the silver ion concentration) during chemical ripening of the silver halide emulsion is preferably from about 8.0 to 11.0.

During chemical ripening, other chemical sensitizers may be added to the compound of the present invention. Examples of such chemical sensitizers include gold compounds described in U.S. Pat. Nos. 2,399,083, 2,597,856, 2,597,915; reducing materials as the amines, stannous salts, etc., described, in U.S. Pat. Nos.

2,487,850, 2,518,698; and the salts of noble metals such as platinum, palladium, iridium, and rhodium.

The silver halide used for the silver halide photographic emulsions of this invention includes silver bromide, silver iodobromide, silver chloroiodobromide, and silver chlorobromide.

The silver halide photographic emulsions of this invention may be prepared by the methods described in *Chimie et Physique Photographique,* edited by P. Glafkides (Paul Montel, 1967); G. F. Duffin, *Photographic Emulsion Chemistry* (The Focal Press, 1966); and V. L. Zelikman, et al., *Making and Coating Photographic Emulsion* (The Focal Press, 1964).

Also, a cadmium salt, a zinc salt, a lead salt, a thallium salt, an iridium salt or a complex salt thereof, a rhodium salt or a complex salt thereof, or an iron salt or a complex salt thereof may be present during precipitation or physical ripening of the silver halide grains.

The silver halide photographic emulsions of this invention may contain various compounds for preventing the formation of fog during the production of photographic materials, preserving or processing the photographic materials, or for stabilizing the photographic properties of the photographic materials. Examples of compounds useful as antifoggants or stabilizers include azoles such as benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (in particular, 1-phenyl-5-mercaptotetrazole), etc.; mercaptopyrimidines; mercaptotriazines; thioketo compounds as oxazolinethione; azaindenes as triazaindenes, tetraazaindenes (in particular, 4-hydroxy substituted (1,3,3a,7)-tetraazaindenes), pentaazaindenes, etc.; benzenethiosulfonic acid; benzenesulfinic acid; and benzenesulfonic acid amide. Among these stabilizers, tetraazaindenes are particularly preferred. These stabilizers are preferably added during chemical ripening, or after ripening but before coating the silver halide emulsion.

The silver halide photographic emulsions may contain an inorganic or organic hardening agent. For example, a chromium salt (chromium alum, chromium acetate, etc.), aldehydes (formaldehyde, glyoxal, glutaraldehyde, etc.), an active vinyl compound (1,3,5-triacryloylhexahydro-S-triazine, etc.), an active halogen compound (2,4-dichloro-6-hydroxy-S-triazine, etc.), a mucohalogenic acid, etc., can be used.

Useful photographic couplers include compounds capable of forming dyes upon oxidative coupling with an aromatic primary amine developing agent (for example, a phenylenediamine derivative, an aminophenol derivative, etc.) in the color development processing. For instance, for magenta couplers, there are 5-pyrazolone couplers, pyrazolobenzimidazole couplers, cyanoacetylcoumarone couplers, open chain acylacetonitrile couplers, etc.; for yellow couplers, there are acylacetoamide couplers (for example, benzoylacetanilides, pivaloylacetanilides, etc.), etc.; and for cyan couplers, there are naphthol couplers, phenol couplers, etc.

The light-sensitive material of the present invention may contain hydroquinone derivatives, aminophenol derivatives, gallic acid derivatives, ascorbic acid derivatives, etc., as color fog preventing agents.

The photographic emulsion layers and other hydrophilic colloid layers of the light-sensitive material may contain a wide variety of known surface active agents. The agents serve various purposes such as improving coating property, preventing static phenomenon, improving slipping property, improving emulsification and dispersion properties, preventing adhesion, as well as improving photographic characteristics (e.g., development acceleration, contrasting, sensitization, etc.).

Examples of useful surface active agents include nonionic surface active agents such as saponin (steroid series), alkylene oxide derivatives (e.g., polyethylene glycol, polyethylene glycol/polypropylene glycol condensate, polyethylene glycol alkyl ether, polyethylene glycol alkylaryl ether, polyethylene glycol esters, polyethylene glycol sorbitan esters, polyalkylene glycol alkylamines, polyalkylene glycol alkylamides, polyethylene oxide addition products of silicones, etc.), glycidol derivatives (e.g., polyglyceride alkenylsuccinate, alkylphenol polyglyceride, etc.), fatty acid esters of polyhydric alcohols, alkyl esters of sugar, urethanes and ethers of sugar; anionic surface active agents containing acid groups as carboxy group, sulfo group, phospho group, sulfuric acid ester group, phosphoric acid ester group, etc., such as triterpenoidsaponin, alkylcarboxylates, alkylsulfonates, alkylbenzenesulfonates, alkylnaphthalenesulfonates, alkylsulfuric acid esters, alkylphosphoric acid esters, N-acyl-N-alkyltaurines, sulfosuccinic acid esters, sulfoalkylpolyoxyethylene alkylphenyl ethers, polyoxyethylene alkylphosphoric acid esters, etc.; amphoteric surface active agents such as amino acids, aminoalkylsulfonic acids, aminoalkylsulfuric acid esters, aminoalkylphosphoric acid esters, alkylbetaines, amine imides, amine oxides, etc.; and cationic surface active agents such as alkylamines, aliphatic quaternary ammonium salts, aromatic quaternary ammonium salts, heterocyclic quaternary ammonium salts (e.g., pyridinium, imidazolium, etc.), phosphonium or sulfonium salts containing heterocyclic rings, and aliphatic phosphonium or sulfonium salts.

In the present invention, fluorine-containing surface active agents can also be used. Examples of useful fluorine-containing surface active agents are described in British Pat. Nos. 1,330,356, 1,524,631, U.S. Pat. Nos. 3,666,478, 3,589,906, Japanese Patent Publication No. 26687/77, Japanese Patent Application (OPI) Nos. 46733/74, 32322/76 (The term "OPI" as used herein refers to a "published unexamined Japanese patent application").

Typical examples of such fluorine-containing surface active agents include N-perfluorooctylsulfonyl-N-propylglycin potassium salt, 2-(N-perfluorooctylsulfonyl-N-ethylamino)ethyl phosphate, N-[4-(perfluorononenyloxy)benzyl]-N,N-dimethylammonium acetate, N-[3-(N',N',N'-trimethylammonio)propyl]perfluorooctylsulfonamido iodide, N-(polyoxyethylenyl)-N-propylperfluorooctyl sulfonamide ($C_8F_{17}SO_2N(C_3H_7)(CH_2CH_2)_nH$) and fluorine-containing succinic acid type compounds.

Furthermore, the emulsions used in the present invention can contain a wide variety of additives, such as antistatic agents, binder vehicles, polymer latexes, matting agents, whitening agents, spectral sensitizing dyes, and dyestuffs. These additives, as well as the supports for the photographic light-sensitive materials, coating methods, and development processing methods for the photographic materials are described in *Research Disclosure,* Vol. 92, pages 107 to 110 (1971, Dec.).

The emulsions of the present invention have high sensitivity and a low degree of fog formation. Also, when the photographic materials are stored for a long period under high temperature and high humidity conditions, there is a smaller degree of reduction in photographic properties such as increased fog with the passage of time, and reduction in sensitivity.

The present invention can be applied to any type of photographic light-sensitive material. For example, it can be applied to ordinary black-and-white light-sensitive materials, light-sensitive materials for lithography, light-sensitive materials for X-ray, color negative light-sensitive materials, color papers, color reversal light-sensitive materials, auto-positive light-sensitive materials, and light-sensitive materials for a diffusion transfer process.

The present invention will be explained in greater detail with reference to the following examples. However, the present invention should not be construed as being limited thereto.

EXAMPLE 1

To a silver iodobromide gelatino emulsion (mean grain size of silver halide grains being 1.3 microns) containing 1.5 mol% silver iodide, 0.6 mg per mol of silver halide of chloroauric acid and 3.4 mg per mol of silver halide of sodium thiosulfate were added. The emulsion was heated for 50 minutes at 60° C. to perform ripening. To the silver halide emulsion thus obtained, 4-hydroxy-6-methyl-1,3,3a,7-tetraazaindene as a stabilizer, 5-nitrobenzotriazole as an antifogging agent and further the compound shown in Table 1 below were added. The resulting mixture was coated on a film to prepare Samples (1) to (8), respectively. Each of these samples were exposed using a sensitometer and developed for 90 seconds using a developer, RD-III (made by Fuji Photo Film Co., Ltd.) for an automatic processer, Fuji-RN (made by Fuji Photo Film Co., Ltd.). The photographic properties of the samples were measured and the results are shown in Table 1 below. In Table 1, the sensitivity of Sample (1) was taken as 100, and the other sensitivities are shown relatively.

TABLE 1

| Sample No. | Compound | Amount Added (g/mol AgX) | Sensitivity | Fog |
|---|---|---|---|---|
| (1) | none | — | 100 | 0.03 |
| (2) | Compound (I-3) | 10 | 110 | 0.03 |
| (3) | Compound (I-4) | 10 | 120 | 0.04 |
| (4) | Compound (I-7) | 10 | 112 | 0.05 |
| (5) | Compound (I-9) | 10 | 115 | 0.04 |
| (6) | Compound (I-14) | 10 | 110 | 0.05 |
| (7) | Compound (I-19) | 10 | 108 | 0.04 |
| (8) | Compound for Comparison* | 10 | 100 | 0.03 |

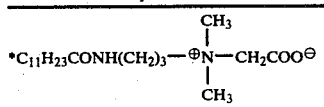

(described in U.S. Pat. No. 3,843,368)

It is apparent from the results shown in Table 1 above that Samples (2) to (7) (using the compounds according to the present invention) have high sensitivity without an accompanying increase in the formation of fog. On the other hand, the compounds (used for comparison) did not show such effects.

EXAMPLE 2

An aqueous gelatin solution containing potassium iodide and potassium bromide was maintained at 70° C. with stirring. To this solution was added, simultaneously, an aqueous solution of potassium bromide and an aqueous solution of silver nitrate to prepare a silver iodobromide emulsion (containing 5 mol% silver iodide) having 0.8 micron mean grain size.

The silver halide emulsion was cooled, set, and washed with water to remove the unnecessary salts in a conventional manner. The pH value and pAg value of the emulsion were adjusted to 6.5 and 8.9, respectively. The emulsion was heated at 60° C., to which sodium thiosulfate and potassium chloroaurate were added and subjected to chemical ripening for 60 minutes.

After adding the sensitizing dye, the stabilizer, the color coupler, the gelatin hardener, the coating aid described below, and the compound described in Table 2 below, the silver halide emulsion was coated on a cellulose acetate film support and dried.

Sensitizing Dye: 5,5'-dichloro-3,3'-di(γ-sulfopropyl)-9-ethyloxacarbocyanine sodium salt
Stabilizer: 4-hydroxy-6-methyl-1,3,3a,7-tetraazaindene
Coupler: 1-(2,4,6-trichlorophenyl)-3-[3-(2,4-di-ter-tamylphenoxy)acetamido]benzamido-5-pyrazolone
Gelatin Hardener: 2,4-dichloro-6-hydroxy-S-triazine
Coating Aid: sodium dodecylbenzenesulfonate Each of these samples was exposed (1/100 second) through an optical wedge and subjected to the color development processing described below. The photographic properties of the samples were measured and the results were shown in Table 2 below.

In Table 2, the photographic sensitivity is shown by a reciprocal of the exposure amount required for obtaining an optical density of fog value+0.20 and the sensitivity of Sample (9) is taken as 100 and the other sensitivities are shown relatively.

| Processing Step | Temperature (°C.) | Time |
|---|---|---|
| 1. Color development | 38 | 3 min 15 sec |
| 2. Bleach | " | 6 min 30 sec |
| 3. Wash | " | 3 min 15 sec |
| 4. Fix | " | 6 min 30 sec |
| 5. Wash | " | 3 min 15 sec |
| 6. Stabilization | " | 3 min 15 sec |

The compositions of the processing solutions used in the above processing were as follows:

| | |
|---|---|
| Color Developer Solution | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamino)-2-methylaniline Sulfate | 4.5 g |
| Water to make | 1 l |
| Bleaching Solution | |
| Ammonium Bromide | 160.0 g |
| Aqueous Ammonia (28%) | 25.0 ml |
| Ethylenediaminetetraacetic Acid Sodium Iron Salt | 130 g |
| Glacial Acetic Acid | 14 ml |
| Water to make | 1 l |
| Fixing Solution | |
| Sodium Tetrapolyphosphate | 2.0 g |
| Sodium Sulfite | 4.0 g |
| Ammonium Thiosulfate (70%) | 175.0 ml |
| Sodium Hydrogensulfite | 4.6 g |
| Water to make | 1 l |
| Stabilization Solution | |
| Formalin | 8.0 ml |

-continued

| | |
|---|---|
| Water to make | 1 l |

TABLE 2

| Sample No. | Compound | Amount Added (g/mol AgX) | Sensitivity | Fog |
|---|---|---|---|---|
| (9) | none | — | 100 | 0.10 |
| (10) | Compound (I-2) | 10 | 112 | 0.11 |
| (11) | Compound (I-3) | 10 | 131 | 0.11 |
| (12) | Compound (I-4) | 10 | 125 | 0.10 |
| (13) | Compound (I-7) | 10 | 108 | 0.11 |
| (14) | Compound (II-1) | 10 | 112 | 0.12 |
| (15) | Compound (I-9) | 10 | 117 | 0.12 |
| (16) | Compound (I-13) | 10 | 105 | 0.10 |
| (17) | Compound (I-20) | 10 | 108 | 0.11 |

It is apparent from the results shown in Table 2 above that in Samples (10) to (17) (according to the present invention) the sensitivity is increased without an accompanying increase in the formation of fog.

While the invention has been described in detail and with reference to specific embodiments thereof, it will be apparent to one skilled in the art that various changes and modifications can be made therein without departing from the spirit and scope thereof.

What is claimed is:

1. A silver halide photographic light-sensitive material comprising a support having coated thereon at least one silver halide emulsion layer, said photographic light-sensitive material containing at least one compound selected from the group consisting of a compound represented by the following general formula (I) and a compound represented by the following general formula (II), wherein the surface tension of a 1% by weight aqueous solution of the compound represented by general formula (I) or (II) at a temperature of 20° C. is 45 dyne/cm or more, in at least one layer of the silver halide emulsion layer and other hydrophilic colloid layers thereof in a sufficient amount to sensitize the silver halide emulsion without being accompanied by an undesirable increase in the formation of fog:

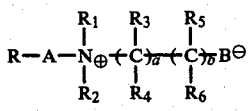

General Formula (I)

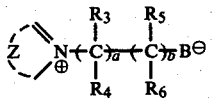

General Formula (II)

wherein R represents an alkyl group having 1 to 6 carbon atoms which may be substituted, an aryl group having 6 to 11 carbon atoms which may be substituted, or an aralkyl group having 7 to 12 carbon atoms which may be substitute; A represents a s bond or a divalent connecting group which links R and the nitrogen atom; $R_1$ and $R_2$ are independently an alkyl group having 1 to 6 carbon atoms which may be substituted, or an aralkyl group having 7 to 11 carbon atoms which may be substituted, or where A represents a s bond, one of $R_1$ and $R_2$ may represent an atomic group necessary to form a heterocyclic ring containing the quaternary nitrogen atom together with R; a and b each represents 0 or a positive integer, provided that a and be are not both 0; $R_3$, $R_4$, $R_5$ and $R_6$ each represents hydrogen or an alkyl having 1 to 6 carbon atoms which may be substituted and when b is not 0, at least one of $R_5$ and $R_6$ is a different group from $R_3$ or $R_4$; B represents —COO or —$SO_3$; and Z represents an atomic group necessary to form a heterocyclic ring.

2. A silver halide photographic light-sensitive material as claimed in claim 1, wherein the substituent for the alkyl group represented by R is a hydroxy group, a halogen atom or a

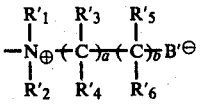

group (wherein $R'_1$, $R'_2$, $R'_3$, $R'_4$, $R'_5$, $R'_6$ and B' each has the same meaning as defined for $R_1$, $R_2$, $R_3$, $R_4$, $R_5$, $R_6$ and B as described in claim 1, or $R_1$ and $R'_1$ and $R_2$ and $R'_2$ are bonded to each other to form a heterocyclic ring).

3. A silver halide photographic light-sensitive material as claimed in claim 2, wherein the heterocyclic ring formed from $R_1$ and $R'_1$ is

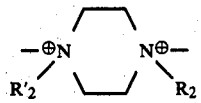

wherein $R_2$ and $R'_2$ each has the same meaning as defined in claim 2.

4. A silver halide photographic light-sensitive material as claimed in claim 1, wherein the substituent for the aryl group represented by R is a lower alkyl group, a hydroxy group, a halogen atom or a nitro group.

5. A silver halide photographic light-sensitive material as claimed in claim 1, wherein the substituent for the aralkyl group represented by R is a lower alkyl group, a hydroxy group, a halogen atom or a nitro group.

6. A silver halide photographic light-sensitive material as claimed in claim 1, wherein R represents an alkyl group having 1 to 6 carbon atoms which may be substituted.

7. A silver halide photographic light-sensitive material as claimed in claim 1, wherein the divalent connecting group represented by A is an —O— group, a —COO—$R_7$— group (wherein $R_7$ represents a divalent connecting group), an —O—CO—$R_7$— group (wherein $R_7$ has the same meaning as defined above) or a

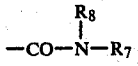

group (wherein $R_7$ has the same meaning as defined above; and $R_8$ represents a hydrogen atom, an alkyl group having 1 to 6 carbon atoms which may be substituted or an atomic group necessary to form a heterocyclic ring together with $R_1$, $R_2$ and $R_7$).

8. A silver halide photographic light-sensitive material as claimed in claim 7, wherein the divalent connecting group represented by $R_7$ is an alkylene group having 1 to 6 carbon atoms.

9. A silver halide photographic light-sensitive material as claimed in claim 1, wherein said photographic light-sensitive material containing at least one compound selected from the group consisting of a compound represented by the general formula (I) in at least one layer of the silver halide emulsion layer and other hydrophilic colloid layer thereof.

10. A silver halide photographic light-sensitive material as claimed in claim 7, wherein the substituent for the alkyl group represented by $R_8$ is a hydroxy group or a halogen atom.

11. A silver halide photographic light-sensitive material as claimed in claim 1, wherein the substituent for the alkyl group represented by $R_1$ or $R_2$ is a hydroxy group or a halogen atom.

12. A silver halide photographic light-sensitive material as claimed in claim 1, wherein the substituent for the aralkyl group represented by $R_1$ or $R_2$ is a hydroxy group, a halogen atom, a nitro group or a lower alkyl group.

13. A silver halide photographic light-sensitive material as claimed in claim 1, wherein the aralkyl group is a benzyl group.

14. A silver halide photographic light-sensitive material as claimed in claim 1, wherein the heterocyclic ring formed from $R_1$ or $R_2$ together with R is a 5-membered or 6-membered saturated heterocyclic group which may contain an oxygen atom or a nitrogen atom which is not a quaternary nitrogen atom.

15. A silver halide photographic light-sensitive material as claimed in claim 1, wherein the substituent for the alkyl group represented by $R_3$, $R_4$, $R_5$ or $R_6$ is a hydroxy group or a halogen atom.

16. A silver halide photographic light-sensitive material as claimed in claim 1, wherein the heterocyclic ring represented by Z is a 5-membered or 6-membered heterocyclic ring including the quaternary nitrogen atom.

17. A silver halide photographic light-sensitive material as claimed in claim 1, wherein said compound is present in a silver halide emulsion layer and/or a layer adjacent thereto.

18. A silver halide photographic light-sensitive material as claimed in claim 1, wherein said compound is present in a silver halide emulsion layer.

19. A silver halide photographic light-sensitive material as claimed in claim 1, wherein the amount of said compound is from 0.001 mol to 1 mol per mol of silver halide in the silver halide emulsion layer.

20. A silver halide photographic light-sensitive material as claimed in claim 1, wherein the amount of said compound is from 0.01 mol to 0.5 mol per mol of silver halide in the silver halide emulsion layer.

21. A silver halide photographic light-sensitive material as claimed in claim 18, wherein said silver halide emulsion is prepared by adding said compound to the silver halide emulsion during or after chemical ripening thereof, but before coating of said emulsion.

22. A silver halide photographic light-sensitive material as claimed in claim 21, wherein the pAg of the silver halide emulsion during chemical ripening is from about 8.0 to 11.0.

23. A silver halide photographic light-sensitive material as claimed in claim 1, wherein said silver halide emulsion is chemically sensitized.

24. A silver halide photographic light-sensitive material as in claim 1, wherein R represents a methyl group, an ethyl group, a propyl group, a hydroxyethyl group, a

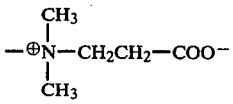

group, a phenyl group, a p-hydroxyphenyl group, or a benzyl group; A represents a $\sigma$ bond or a

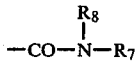

group wherein $R_7$ represents a divalent connecting group; and $R_8$ represents hydrogen, or an alkyl group having from 1 to 6 carbon atoms; $R_1$ and $R_2$ are independently a methyl group, an ethyl group, a hydroxyethyl group, or an alkyl group having from 1 to 6 carbon atoms which may be substituted, or an atomic group necessary to form a heterocyclic ring containing the quaternary nitrogen atom together with R; wherein when one of $R_1$ and $R_2$ represents an atomic group forming a heterocyclic ring said heterocyclic ring is selected from the group consisting of a piperidine ring, a piperazine ring, or a morpholine ring; $R_3$, $R_4$, $R_5$, and $R_6$ each represents hydrogen, a methyl group, or an ethyl group; and Z represents a pyridine ring, an imidazole ring, or a benzimidazole ring.

25. A silver halide photographic light-sensitive material as in claim 1, wherein said compound according to general formula (I) is selected from the group consisting of

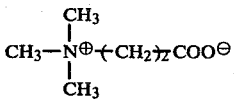

(I-1)

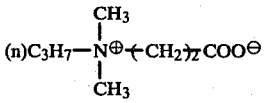

(I-2)

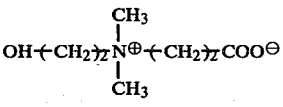

(I-3)

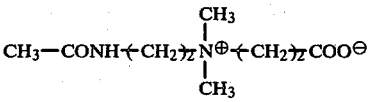

(I-4)

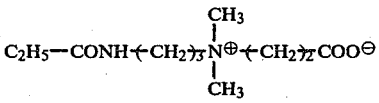

(I-5)

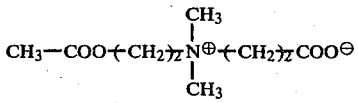

(I-6)

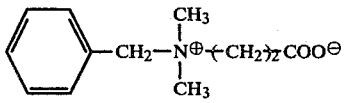

(I-7)

-continued
(I-8)
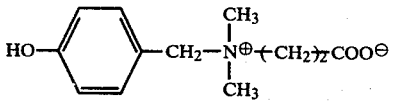
(I-9)
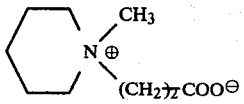
(I-10)
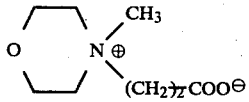
(I-11)
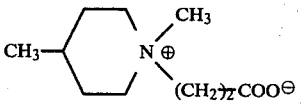
(I-12)
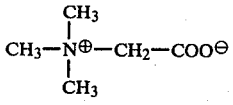
(I-13)
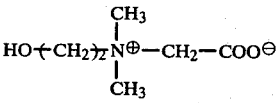
(I-14)
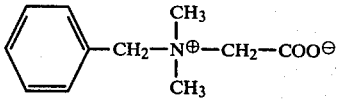
(I-15)
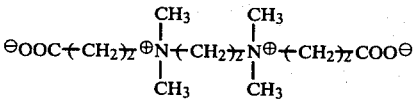
(I-16)
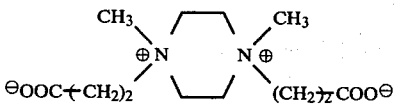
(I-17)
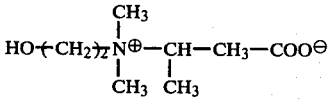
-continued
(I-18)
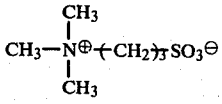
(I-19)
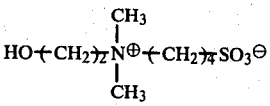
(I-20)
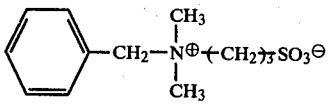
and the compound according to general formula (II) is selected from the group consisting of
(II-1)
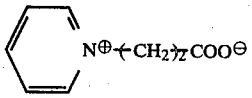
(II-2)
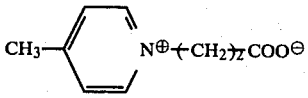
(II-3)
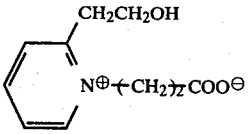
(II-4)
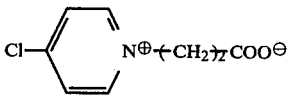
(II-5)
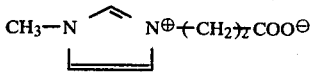
(II-6)
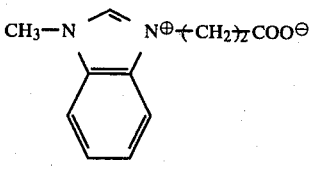
(II-7)
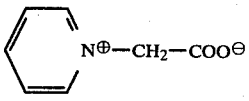
* * * * *